US006819213B2

(12) United States Patent
Marshall et al.

(10) Patent No.: US 6,819,213 B2
(45) Date of Patent: Nov. 16, 2004

(54) INDUCTIVE DEVICE

(75) Inventors: Bowen F. Marshall, Rockport, ME (US); Marc A. Craig, Appleton, ME (US)

(73) Assignee: Tibbetts Industries, Inc., Camden, ME (US)

( * ) Notice: Subject to any disclaimer, the term of this patent is extended or adjusted under 35 U.S.C. 154(b) by 67 days.

(21) Appl. No.: 10/349,252

(22) Filed: Jan. 21, 2003

(65) Prior Publication Data

US 2003/0141954 A1 Jul. 31, 2003

Related U.S. Application Data

(63) Continuation-in-part of application No. 10/057,248, filed on Jan. 25, 2002, now abandoned.

(51) Int. Cl.[7] ..... H01F 27/30; H01F 38/20

(52) U.S. Cl. ..... 336/192; 336/174; 336/208; 336/198

(58) Field of Search ..... 336/192, 198, 336/208; 29/596, 597, 605

(56) References Cited

U.S. PATENT DOCUMENTS 4,462,016 A * 7/1984 Bland et al. ..... 336/192
5,447,455 A * 9/1995 Plosser ..... 439/863
5,691,583 A * 11/1997 Suzuki et al. ..... 310/49 R
5,760,669 A * 6/1998 Dangler et al. ..... 336/65
5,952,908 A * 9/1999 Kubo ..... 336/192
6,084,225 A * 7/2000 Schmitt ..... 219/672
6,598,824 B2 * 7/2003 Schmidt ..... 242/603

FOREIGN PATENT DOCUMENTS

| | | |
|---|---|---|
| DE | 1563456 A | 5/1970 |
| EP | 0997843 A | 5/2000 |
| FR | 1321333 A | 3/1963 |
| GB | 2019654 A | 10/1979 |

* cited by examiner

*Primary Examiner*—Anh T. Mai
(74) *Attorney, Agent, or Firm*—Lahive & Cockfield, LLP

(57) ABSTRACT

An inductive device comprises a coil having a winding and extending along and spaced from an axis, and a pair of lead wires extending internally between the ends of the coil. The lead wires extend externally from one of said ends for connection to an electrical circuit, and form start and finish posts at the other of said ends. The respective ends of the winding are wound on and electrically connected to the posts, for which purposes the posts extend axially away from the coil in spaced relationship.

11 Claims, 4 Drawing Sheets

INDUCTIVE DEVICE

RELATED APPLICATION

This application is a continuation-in-part of Ser. No. 10/057,248, filed Jan. 25, 2002 now abandoned.

BACKGROUND OF THE INVENTION

This invention relates generally to inductive devices, and more particularly to coils of fine wire and of very small dimensions suitable for use in hearing aids and other devices employing miniature circuitry.

In certain applications, such devices are referred to as telecoils and are installed in a hearing aid to sense the magnetic field of a telephone or other assistive listening system for the hearing impaired. The detection of such fields controls the operation of the electronic circuit of the hearing aid. In current practice, a telecoil typically consists of several thousand turns of fine insulated coil wire, typically on the order of one thousandth inch in diameter, wound on a ferrous or other core of magnetic material. In manufacture, the winding wire may be wound directly on a bobbin of magnetic material which forms a part of the telecoil, or the wire may be wound on a mandrel which is removed after winding, leaving a hollow core into which a ferrous rod is later inserted. The ultrafine coil wire is very fragile and is typically unsuited for connection to external circuit components for that reason. Therefore, it is typically necessary to provide heavier connection or lead wires that extend to such external circuit elements, the lead wires having, for example, five or six times greater diameter and being soldered or otherwise electrically connected to the ends of the fine winding wire. In these miniature devices terminal pads may be provided at one or both ends of the coil or cemented to the exterior body of the coil, and the fine wire may be wrapped around the lead wires which are in turn attached by adhesive or otherwise to the outside of the coil after winding.

One of the objects of the invention is to provide improved coils of minimized diameter and overall coil length.

Another object is to provide an improved structure whereby the lead wires are pre-mounted on the bobbin (or mandrel) prior to winding, thus providing to the winding equipment integral posts for coil wire terminations.

Another object is to provide an improved structure in which neither solder connections nor bare lead wires come into contact with the ultrafine coil wire of the winding.

Another object is to provide an improved construction that eliminates mechanical stress on the solder connections and increases the pull strength of the lead wires when connecting them to external circuit elements.

Another object is to provide a construction in which the lead or connection wires will only be subjected to bending in an area remote from the soldered area during connection of the coil to external circuit elements, as the soldered area typically becomes embrittled and weakened during soldering.

Another object is to provide the foregoing advantages to the coil using conventional winding methods but at reduced costs for parts, tooling and assembly.

Other objects of the invention will be understood from the following detailed description with reference to the appended drawings.

BRIEF SUMMARY OF THE INVENTION

With the foregoing objects in view, this invention features lead wires that extend inwardly of the coil winding from end to end thereof, forming start and finish connection posts at one end of the coil around which the respective ends of the winding wire are wound. Advantageously, the lead wires are preformed and the coil winding is wound over the lead wires, the ends of the winding being extended out to the posts for winding on and electrical connection to the posts.

Another feature is that the foregoing construction can be achieved either by winding the fine coil wire on a bobbin of magnetic material that forms a part of the completed coil, or the fine wire may be wound on a removable mandrel which, after winding, is replaced by a ferrous or other magnetic core or rod.

Another feature is that the improved coil may be formed on any of several presently available winding machines in which the bobbin or mandrel is either rotating or non-rotating.

Other features of the invention and the achievement of other objects hereinabove referred to will be evident from the following description.

DRAWING

DETAILED DESCRIPTION

Figure 5:
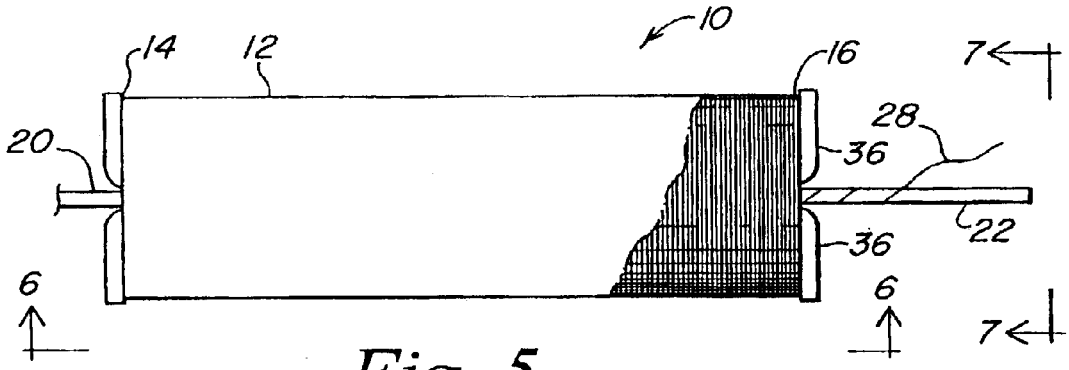
FIG. 5 is an axial elevation of an assembly having a coil wound on the bobbin of FIGS. 1 to 3.
Figure 6:
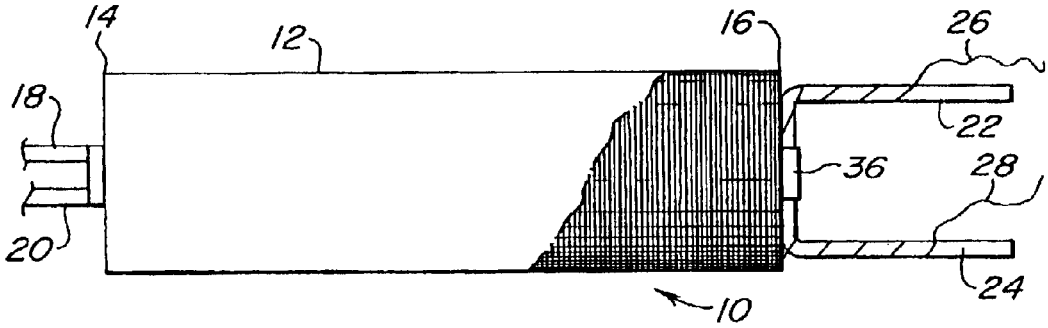
FIG. 6 is an elevation taken on line 6—6 of FIG. 5.
Figure 7:
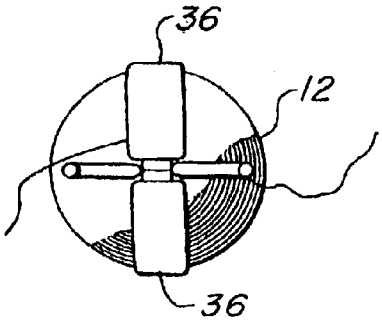
FIG. 7 is an end elevation on line 7—7 of FIG. 5.

Referring to FIGS. 5–7, a coil 10 comprises a winding 12 of several thousand turns of ultrafine wire closely compacted and extending between ends 14 and 16 of the coil. The turns of the winding are spaced from a longitudinal axis a—a of the coil, and a pair of lead wires 18 and 20 extend axially from end to end of the coil through the space so provided.

At the end 14 of the coil the lead wires 18 and 20 extend a sufficient distance for connection to the external circuitry of a hearing aid or other device (not shown). At the end 16 of the coil the lead wires are formed and separated to extend axially away from the coil, forming a start post 22 and a finish post 24. Ends 26 and 28 of the wire of the winding 12 are respectively wrapped on the posts 22 and 24, and soldered or welded thereto.

Figure 1:
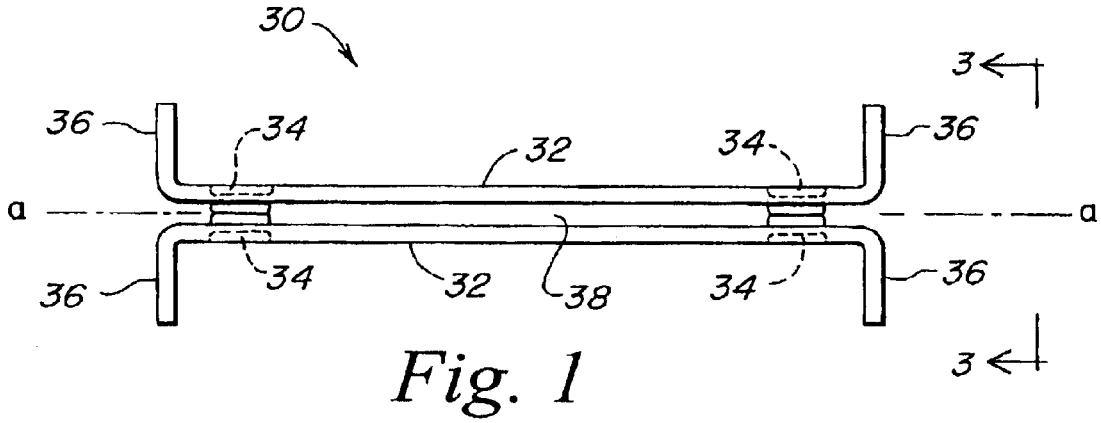
FIG. 1 is a side elevation of a first embodiment of coil bobbin for winding the coil of the invention.
Figure 2:
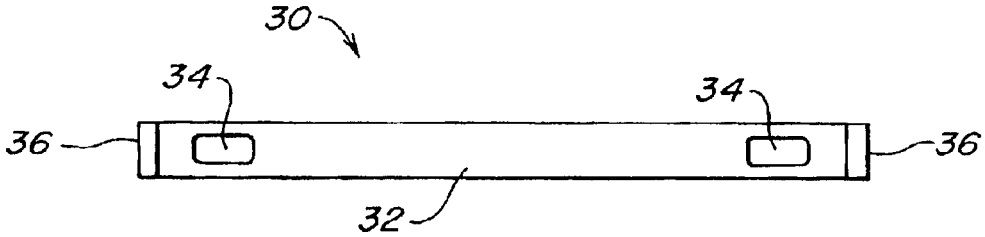
FIG. 2 is a view in plan of the bobbin of FIG. 1.
Figure 3:
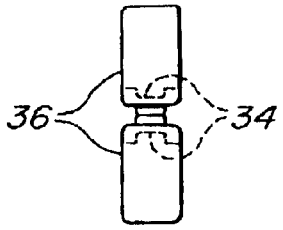
FIG. 3 is a right end elevation on line 3—3 of FIG. 1.

FIGS. 1 to 3 illustrate a first alternative form of bobbin 30 over which the turns of the winding 12 may be formed. The bobbin 30 is formed of two identical pieces 32 of ferrous or other magnetic material blanked from a flat sheet. Each of the pieces 32 is formed with dimples 34, then cut into elongate strips and formed with ends 36 extending normal to the axis a—a. Two of the pieces so formed are placed with their dimples 34 in mutual contact, providing a space 38 between the pieces 32 extending longitudinally of the bobbin 30. The dimples 34 are then welded to form a rigid structure. Other conventional steps of fabrication such as tumbling, annealing and coating may also be performed on the bobbin in preparation for winding the fine wire thereon.

The lead wires 18 and 20, preferably preformed to provide the terminal posts 22 and 24, are extended through the space 38 from end to end of the bobbin 30 in preparation for forming the winding 12 thereon between the ends 36 of the bobbin.

Figure 4:
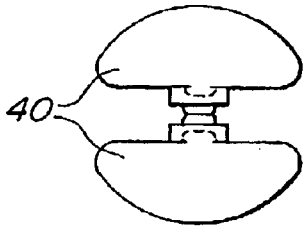
FIG. 4 is an end elevation corresponding to FIG. 3 and illustrating an alternative embodiment of the bobbin.
Figure 8:
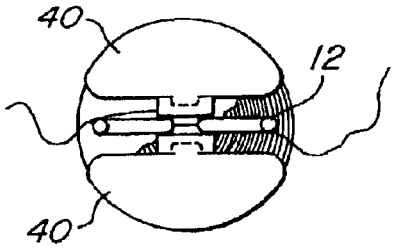
FIG. 8 is an elevation corresponding to FIG. 7 and illustrating the alternative embodiment of FIG. 4.

If desired, the ends 36 of the bobbin may be replaced by ends 40 of more extended area as illustrated by the alternative embodiment of FIGS. 4 and 8. The bobbin ends 40 are preferably shaped to extend only minimally or not at all beyond the diameter of the winding 12 of the coil 10. The ends 40 serve for further confinement of the ends 14 and 16 of the coil 10 during and after the winding operation.

Figure 9:
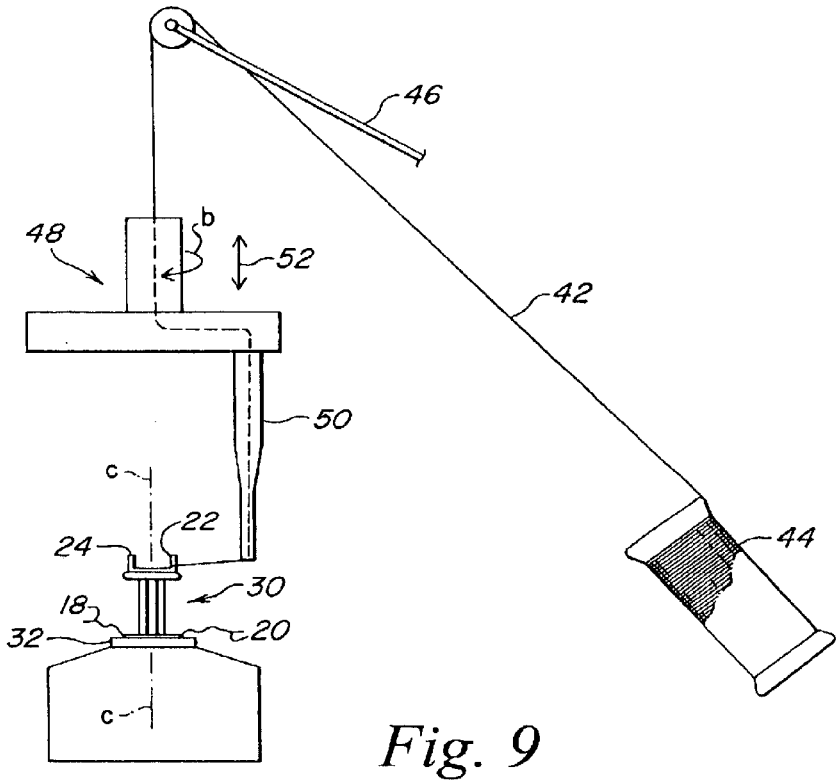
FIG. 9 is a schematic drawing of a conventional flying head multi-axis coil winding machine suitable for forming coils according to the invention.

FIG. 9 illustrates the winding of the coil of the invention on a conventional flying head multi-axis winding machine. The fine wire 42 is drawn from a supply spool 44 over an adjustable tensioning device 46, through a hollow tube wire guide 48, and downwardly through a depending tubular portion 50 thereof. The bobbin 30 is fastened to a chuck 32. The wire guide 48 is the so-called flying head type, being adapted for rotation as indicated by an arrow b about an axis c to form the turns of the winding 12 around the stationery bobbin 30, or alternatively for rotation around either of the respective axes of the start and finish posts 22 and 24 to wrap the ends of the winding wire 12 thereon.

The winding operation begins with the winding of the wire 42 on the start post 22, after which the wire is directed to the space between the ends 14 and 16 of the spool, the axis of rotation of the guide 48 reverting to the axis c—c. Rotation about the axis c—c then begins. As the rotation continues, the wire guide 48 reciprocates vertically as indicated by arrows 52 to distribute the turns of the winding uniformly between the ends 14 and 16 of the coil. Finally, the rotational axis is again shifted to wrap the end of the wire 42 on the finish post 24.

Figure 10:
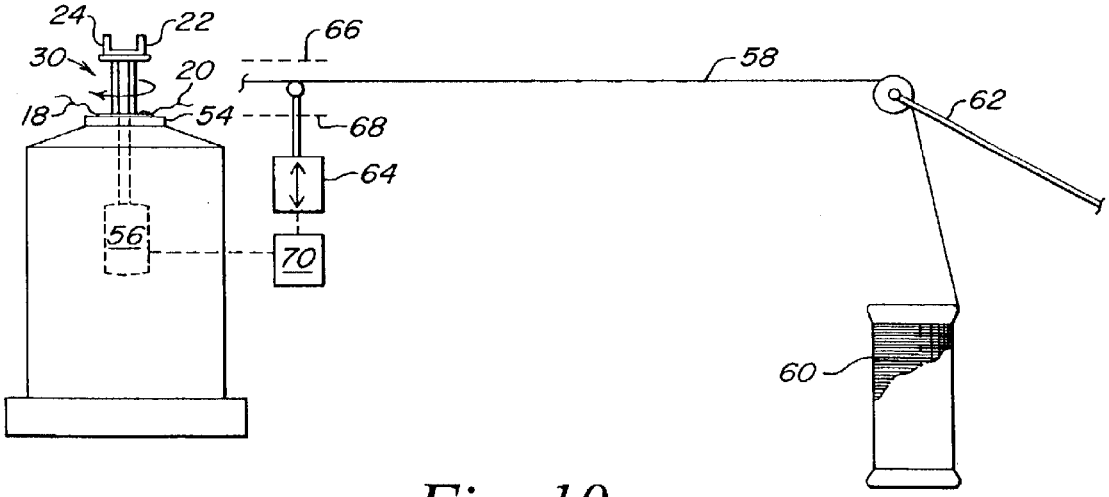
FIG. 10 is a schematic drawing of a rotating chuck winding machine suitable for winding coils according to the invention.
Figure 11:
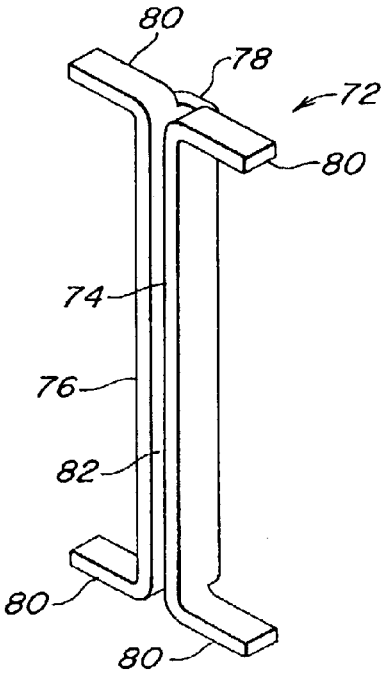
FIG. 11 is a view in perspective of a second embodiment of coil bobbin for winding the coil of the invention.
Figure 12:
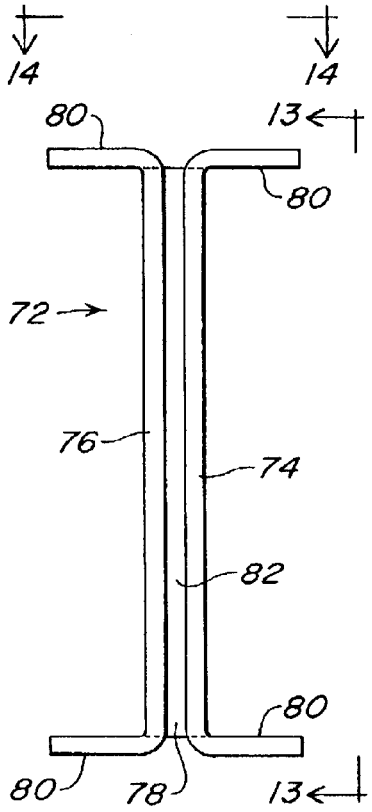
FIG. 12 is a front elevation of the embodiment of FIG. 11.
Figure 13:
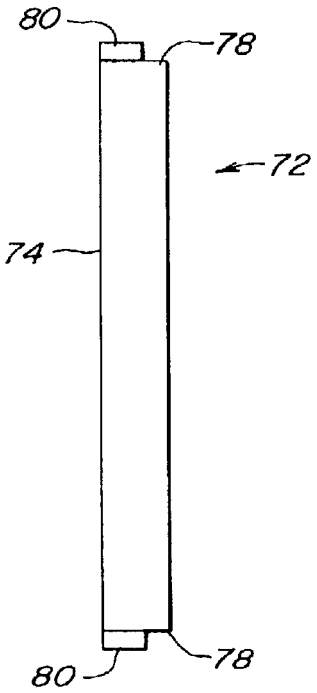
FIG. 13 is a right side elevation taken on line 13—13 of FIG. 12.
Figure 14:
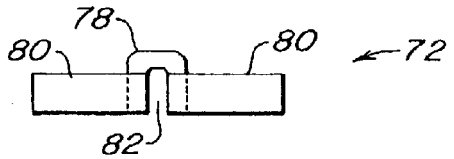
FIG. 14 is an end elevation taken on line 14—14 of FIG. 12.

FIG. 10 illustrates a conventional rotating chuck winding machine having a chuck 54 rotated by a motor 56. Winding wire 58 is fed from a supply spool 60 over an adjustable tensioning device 62 to a traversing wire guide 64 which moves reciprocally between limits 66 and 68 to distribute the turns of the winding uniformly between the ends 14 and 16 of the coil 10.

In operation, an end of the wire 58 is first wrapped on the start post 22 either manually or in any other convenient manner, then fed to the space between the ends 14 and 16 of the bobbin for winding the body of the coil. Finally, the wire is led to the finish post 24 and manually or otherwise wrapped thereon. In accordance with conventional practice, a controller 70 coordinates the speed of rotation of the motor 56 and the reciprocal movement of the guide 64 for controlling the formation of the coil 10.

In either of the winding machines of FIGS. 9 and 10, in place of the bobbin 30 a removable mandrel of suitable form may be placed in the chuck 20 or 54. The mandrel can be formed to accept the lead wires 18 and 20 with the start and finish posts 20 preformed thereon prior to formation of the winding 12. In that case, the mandrel is provided with longitudinally extending slots to accept the lead wires. After completion of the winding including attachment of an end thereof to the finish post 24, the mandrel 28 is removed from the chuck and withdrawn from the coil. A core of ferrous or other magnetic material is then inserted through the coil to complete the inductive device. Alternatively, the lead wires can be mounted in longitudinal slots of a suitable core and the assembly inserted into the coil after forming the winding and withdrawing the mandrel.

In the illustrated embodiments, both of the lead wires 18 and 20 are preformed at the end 16 of the coil 10 with two right angle bends to form radially extending portions thereof for mutually spacing the posts 22 and 24. Alternatively, only one of the lead wires may be bent in this fashion. In either case, the posts 22 and 24 extend in the axial direction of the coil 10 for wrapping the ends of the winding 12 thereon. In a subsequent operation the posts 22 and 24 are advantageously located for automated dip-soldering of the connections to the wires 26 and 28 of the winding without refixturing of the coil. After the soldering operation the posts 22 and 24 are trimmed to a suitable length if necessary and then preferably bent back against the ends 14 and 16 of the coil to minimize its overall length.

Other embodiments may be substituted for that of the bobbin 30, if desired. Advantageously, the one-piece alternative bobbin 72 of FIGS. 11 to 14 may be employed. The bobbin 72 is blanked from a flat sheet of ferrous or other magnetic material to form integral elongate portions 74 and 76 joined by an integral elongate connecting portion 78. Each of the portions 74 and 76 is formed with ends 80 similar in form and function to the bobbin ends 36 in FIGS. 1 to 8. The blank so formed is then folded by bending the connecting portion 78 longitudinally to create an elongate space 82 between the portions 74 and 76, similar in function to the space 38 of FIGS. 1 to 8.

The foregoing description with reference to the winding of the bobbin 30 is fully applicable to the bobbin 72. In addition, the bobbin 72 provides other advantages. Its fabrication, employing fewer parts and fewer steps of fabrication, may be easier and less costly to produce, particularly with regard to alignment of parts and the elimination of welding time and equipment. The bobbin 72 is strong and durable in the form illustrated. With the connecting portion 78 extending the full length of the coil winding between the ends 80, it increases the core cross-section and thereby improves the magnetic performance of the coil. The longitudinal opening on one side of the space 82 allows for faster insertion of both lead wires into this space, and cementing of the wires in this space, from the same side of the bobbin. The connecting portion more fully encloses and contains the cement and leads, making it feasible to use bifilar rather than individual lead wires in some applications.

What is claimed is:

1. An inductive device having, in combination, a coil comprising a continuous winding of insulated wire formed of plural turns compacted around and spaced from an elongate axis, the coil extending between a pair of ends thereof mutually spaced on said axis, and a pair of mutually insulated lead wires extending internally of the winding between said ends, said lead wires extending externally of the winding from one of said ends and being respectively formed at the other of said ends as mutually separated start and finish posts, said posts extending in the axial direction away from the coil, each end of the winding being wrapped around one of said posts and electrically connected thereto.

2. An inductive device according to claim 1, in which at least one of the lead wires is bent to form a portion thereof extending in a direction away from said axis for separation of said lead wires.

3. An inductive device according to claim 2, in which both of the lead wires are bent to form portions thereof extending in mutually displaced directions away from said axis.

4. An inductive device according to claim 1, including a core of magnetic material extending internally of the winding.

5. An inductive device according to claim 4, in which the core is a bobbin comprising a pair of mutually connected members having portions thereof extending axially through the winding and forming spaces for passage of said lead wires.

6. An inductive device according to claim 5, in which each of said members is formed of sheet material, said axially extending portions thereof being connected in mutually spaced relationship.

7. An inductive device according to claim 6, in which each of said members has portions thereof extending in planes substantially normal to said axis for confining the winding in the axial direction.

8. An inductive device according to claim 4, in which the core is a bobbin having at least two portions thereof extending axially through the winding and mutually spaced to provide a passage for said lead wires.

9. An inductive device according to claim 8, in which the core is a unitary body formed of sheet material.

10. An inductive device according to claim 9, in which the core comprises a connecting portion extending integrally between said at least two portions and bent to form a closed side of said passage and a longitudinal opening on the other side thereof for insertion of said lead wires.

11. An inductive device according to claim 10, in which said lead wires are cemented within said passage.

* * * * *